US008992001B2

(12) United States Patent
Wanibuchi et al.

(10) Patent No.: US 8,992,001 B2
(45) Date of Patent: Mar. 31, 2015

(54) PRINTER

(75) Inventors: Hiroshi Wanibuchi, Matsumoto (JP); Akio Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 157 days.

(21) Appl. No.: 13/212,066

(22) Filed: Aug. 17, 2011

(65) Prior Publication Data

US 2012/0044309 A1 Feb. 23, 2012

(30) Foreign Application Priority Data

Aug. 18, 2010 (JP) ..... 2010-182825

(51) Int. Cl.
*B41J 2/01* (2006.01)
*B41J 15/16* (2006.01)
*B41J 15/04* (2006.01)

(52) U.S. Cl.
CPC ..... *B41J 15/165* (2013.01); *B41J 15/042* (2013.01)
USPC ..... 347/104; 347/101

(58) Field of Classification Search
CPC ..... B41J 2/01; B41J 11/007; B41J 11/06; B41J 11/0085; B41J 13/103; B41J 11/0065
USPC ..... 347/104
See application file for complete search history.

(56) References Cited

U.S. PATENT DOCUMENTS 5,026,185 A * 6/1991 Kusabuka ..... 400/618
5,238,235 A * 8/1993 Nitta et al. ..... 271/9.09
5,846,007 A * 12/1998 Nakayama et al. ..... 400/624
6,412,992 B2 * 7/2002 Mogi ..... 400/579
7,036,905 B2 * 5/2006 Nagai et al. ..... 347/22
7,036,923 B2 * 5/2006 Takagi et al. ..... 347/104
7,165,741 B2 1/2007 Takagi et al.
7,984,871 B2 * 7/2011 Nagata ..... 242/563.1
2006/0013632 A1 * 1/2006 Shimomura et al. ..... 400/120.02
2007/0264070 A1 11/2007 Loo et al.
2008/0170111 A1 * 7/2008 Suzuki et al. ..... 347/104
2008/0251991 A1 10/2008 Doyo
2009/0255971 A1 10/2009 Nakamaki et al.
2010/0220167 A1 * 9/2010 Nagata ..... 347/104
2010/0221058 A1 * 9/2010 Inoue ..... 400/642
2010/0296855 A1 * 11/2010 Hopkins et al. ..... 400/619
2011/0242245 A1 * 10/2011 Okazaki ..... 347/104

FOREIGN PATENT DOCUMENTS

CN 101072686 A 11/2007
JP 546451 U 6/1993
JP 2004-268269 9/2004

(Continued)

*Primary Examiner* — Manish S Shah
*Assistant Examiner* — Jeremy Delozier
(74) *Attorney, Agent, or Firm* — Lowe Hauptman & Ham, LLP

(57) ABSTRACT

Problems related to being unable to convey recording paper in a printer due to the tension guide that guides the recording paper while tensioning the paper are eliminated. A removable guide 40 can be removably installed to the tension guide 26 of the printer 1. The removable guide 40 has a second guide surface that is defined by a pair of rollers 45, 46. When printing on recording paper 25A that has a high friction coefficient for making wrist bands, the removable guide 40 is installed to the tension guide 26, the recording paper 25A is passed over the rollers 45, 46, and the recording paper 25A is guided to the paper feed roller 30 while tension is maintained. The recording paper 25A can be reliably conveyed because the paper feed load of the removable guide 40 pressed to the recording paper 25A by the tension guide 26 is small.

10 Claims, 9 Drawing Sheets

(56) References Cited

FOREIGN PATENT DOCUMENTS

| | | | |
|---|---|---|---|
| JP | 2005-133265 | 5/2005 | |
| JP | 200991146 | A | 4/2009 |
| JP | 2009-269399 | | 11/2009 |

* cited by examiner

PRINTER

BACKGROUND

1. Technical Field

The present invention relates to a printer that conveys roll paper pulled from a paper roll stored in a roll paper compartment passed the printing position of a printhead by means of a paper feed roller and prints. More particularly, the invention relates to a printer that guides recording paper to the paper feed roller while maintaining specified tension on the recording paper by means of an elastically displaceable tension guide in order to reduce variation in the feed load on the paper feed roller.

2. Related Art

In printers that print on roll paper delivered from a paper roll, the paper feed load on the paper feed roller changes greatly according to variation in the inertial weight of the paper roll, for example, and can easily cause the roll paper feed precision to vary. For example, if the paper feed precision varies when printing a barcode with precise spacing, the thickness of the bars and the spaces between bars varies if the paper feed precision changes, and it may not be possible to print a barcode that can be accurately read. To solve this problem, Japanese Unexamined Patent Appl. Pub. JP-A-2009-269399 teaches a method of guiding the recording paper delivered from a paper roll to the paper feed roller while maintaining specific tension on the recording paper by means of an elastically displaceable tension guide, and using this elastic displacement of the tension guide to suppress variation in the roll paper feed load acting on the paper feed roller.

Different types of recording paper are also known. There is, for example, recording paper for creating wrist bands that are attached and worn around the patient's wrist or ankle in hospitals as described in Japanese Unexamined Patent Appl. Pub. JP-A-2005-133265. This recording paper is a narrow band of a constant width that can be cut to a certain length, and is used as a wrist band after printing the required information using an inkjet printer, for example, and then cutting the paper to length. This type of recording paper can also be supplied in rolls.

In addition to having different widths, the recording paper can thus be made of different materials, have a coated surface, and vary in other ways. Recording paper for making wrist bands, for example, may be made from a non-woven cloth, and the back side that is worn against the patient's skin may be surface treated to increase the friction coefficient for greater comfort and prevent the wrist band from slipping, for example. The recording paper may be coated with a high friction coefficient material, for example, or be treated to increase surface roughness and improve sliding resistance.

Problems such as described below can result in a printer that guides the recording paper to the paper feed roller while maintaining tension on the recording paper by means of a tension guide when printing on recording paper with different surface characteristics, particularly different friction coefficients.

For example, because the friction coefficient is higher when conveying recording paper for making wrist bands than when conveying plain recording paper, sliding resistance between the recording paper and the paper feed guide is high. More specifically, because the tension guide urges the recording paper with a specific elastic force, the sliding resistance is much greater than other recording paper guide parts inside the printer. When the friction coefficient of the recording paper is high, the sliding resistance with the tension guide may exceed the paper feed force of the paper feed roller, and it may not be possible to feed the recording paper.

SUMMARY

A printer according to the invention prevents paper conveyance being disabled by the tension guide even when printing on recording paper with a high friction coefficient.

A printer according to a first aspect of the invention has a printhead; a paper feed roller that conveys a web of recording paper to the printhead printing position; a tension guide that has a first guide surface that guides the recording paper in the direction of the paper feed roller, and can be elastically displaced to apply specific tension to the recording paper; and a removable guide that has a second guide surface with a different friction coefficient than the first guide surface, and is removably installable to the tension guide; wherein when the removable guide is installed to the tension guide, the removable guide is elastically displaceable in unison with the tension guide, and the recording paper is guided by the second guide surface.

A tension guide having the first guide surface could be provided as standard equipment, and a removable guide having a second guide surface with a lower friction coefficient than the first guide surface could also be provided. When printing on recording paper that is used to make wrist bands and has a higher friction coefficient than regular recording paper (plain paper), the removable guide is installed to the tension guide for printing. Recording paper with a high friction coefficient is therefore guided by the second guide surface having a low friction coefficient, the sliding resistance acting on the recording paper can be suppressed to the same level as plain paper, and becoming unable to convey the recording paper can be prevented. Furthermore, because the removable guide can be elastically displaced in unison with the tension guide, the recording paper can always be held in an appropriately tensioned state and tension guide functionality is not lost. In addition, because compatibility with recording paper having a high friction coefficient can be achieved by simply installing the removable guide, the invention is significantly more cost effectiveness than using a dedicated printer.

In another aspect of the invention, the friction coefficient of the first guide surface is greater than or equal to 0.3; and the friction coefficient of the second guide surface is less than or equal to 0.2.

This aspect of the invention enables using a tension guide with the first guide surface when printing on commonly used recording paper, using the removable guide with the second guide surface when using recording paper with a higher friction coefficient, thereby enabling a paper feed operation suitable to the recording paper being used.

In another aspect of the invention, the removable guide includes a main guide that is removably installable to the tension guide, and at least one roller that is freely rotatably supported by the main guide, and determines the second guide surface.

If a roller or other type of rolling body is used, the roller rotates in contact with the recording paper, the sliding resistance acting on the recording paper is therefore effectively zero, and recording paper having a surface with a high friction coefficient can be guided smoothly. Furthermore, because roller surface wear is significantly less than when the recording paper slides over the guide surface, the service life of the guide surface can be extended.

Further alternatively, the removable guide includes a main guide that is removably installable to the tension guide, and a film, sheet, or plate with a lower friction coefficient than the first guide surface applied to the surface of the main guide, or a surface layer made of a material with a lower friction coefficient than the first guide surface formed on the surface of the main guide; and the second guide surface is determined by the film, sheet, or plate, or by the surface of the surface layer.

In another aspect of the invention, the removable guide has a pair of paper width guide surfaces formed on opposite sides of the second guide surface. Because the paper width is narrower than common recording paper when using recording paper for making wrist bands, for example, recording paper of different widths can be appropriately guided without skewing or meandering by disposing a paper width guide surface to the removable guide.

In another aspect of the invention, a plurality of removable guides each having a different surface characteristics on the second guide surface are used as the removable guide, and the removable guides can be selectively installed to the tension guide.

This aspect of the invention enables guiding different types of recording paper with appropriate sliding resistance by using removable guides suitable to plural different recording papers having different friction coefficients.

A printer according to another aspect of the invention also has a roll paper compartment that stores the recording paper wound in a paper roll, and the recording paper supplied from the paper roll stored in the roll paper compartment can be guided to the paper feed roller passed the intervening tension guide.

Effect of the Invention

When a removable guide with a second guide surface having a different friction coefficient is provided, the removable guide can be removably installed to the tension guide having a first guide surface in a printer according to the invention. When the removable guide is installed, the recording paper is guided by the second guide surface, and the removable guide can be elastically displaced in unison with the tension guide.

Therefore, when printing on recording paper that has a high friction coefficient, for example, the removable guide is installed to guide the recording paper by means of the second guide surface having a low friction coefficient. As a result, the recording paper can be guided to the paper feed roller with a suitable sliding load, and being unable to convey the recording paper due to the sliding resistance between the tension guide and recording paper having a high friction coefficient can be reliably prevented. Furthermore, because recording paper with different friction coefficients can be handled by installing or removing the removable guide as needed, a configuration that can desirably feed recording paper with different friction coefficients passed the tension guide can be provided at an extremely low price.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the invention is described below with reference to the accompanying figures.

General Configuration

Figure 1:
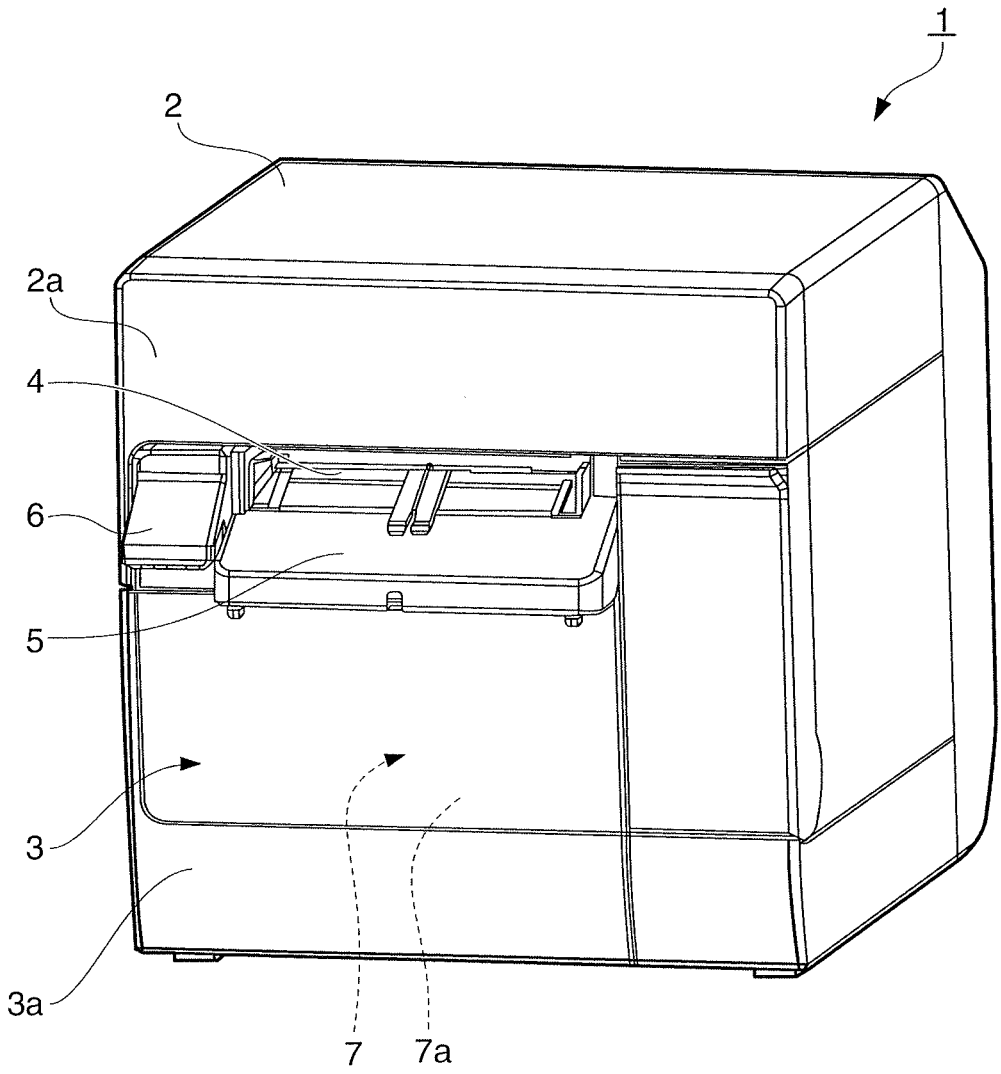
FIG. 1 is an external oblique view of a printer according to a preferred embodiment of the invention.
Figure 2:
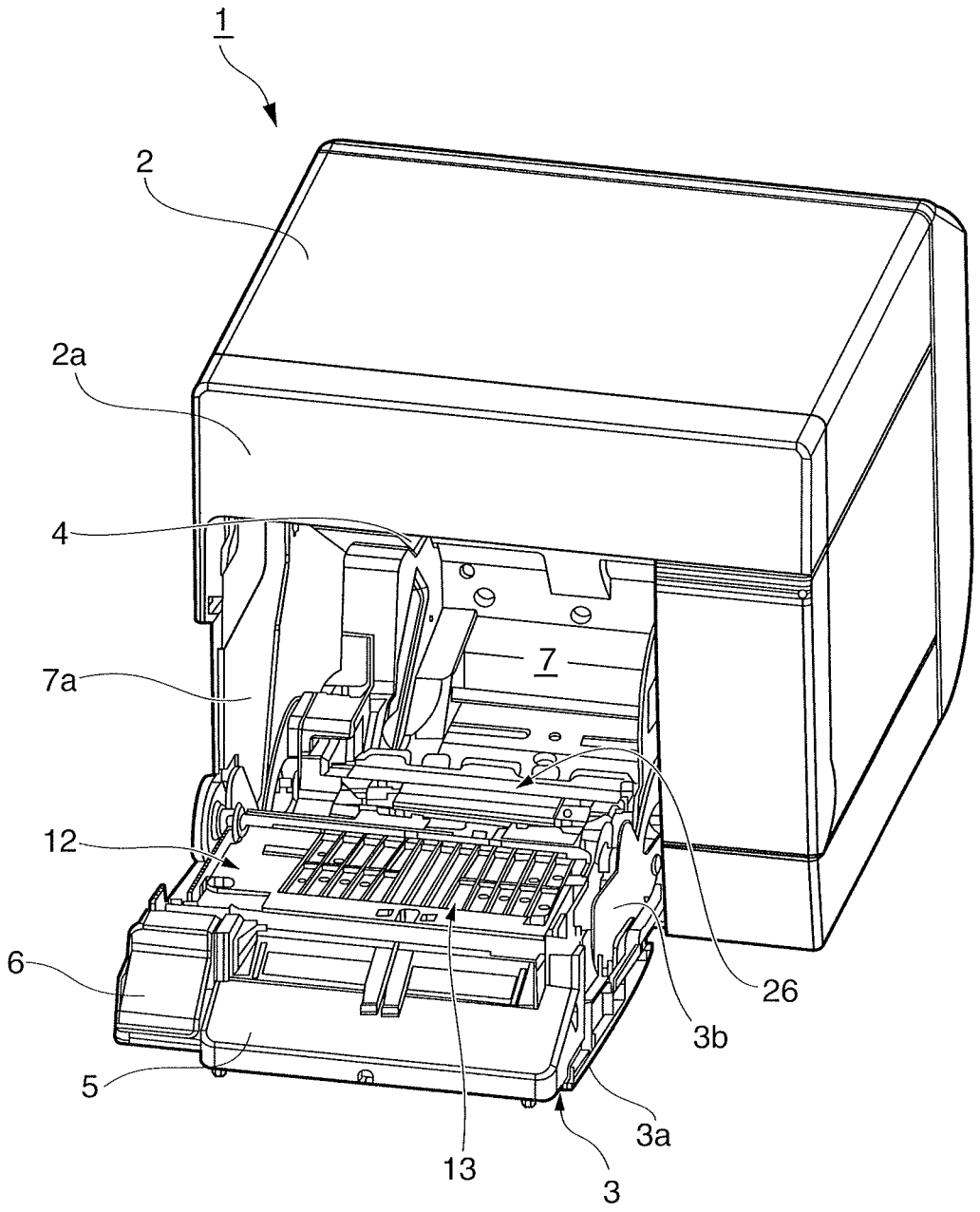
FIG. 2 is an external oblique view of the printer with the access cover open.

FIG. 1 is an external oblique view of a printer according to a preferred embodiment of the invention, and FIG. 2 is an external oblique view of the printer with the access cover fully open. The printer 1 has a housing 2 that is a basically rectangular box, and a cover unit 3 attached to the front of the housing 2. The cover unit 3 includes an access cover 3*a* and an opening mechanism 3*b* such as a four-joint linkage mechanism for opening and closing the access cover 3*a*. A paper exit 4 of a specific width is formed in the front of the outside case 2*a* of the printer housing 2. A discharge guide 5 projects forward below the paper exit 4, and a cover release lever 6 is disposed beside the discharge guide 5. A rectangular opening 7*a* for loading and removing roll paper in the roll paper compartment 7 formed inside the printer housing 2 is formed in the outside case 2*a* below the discharge guide 5 and cover release lever 6, and this opening 7*a* is closed by the access cover 3*a*.

Internal Structure

Figure 3:
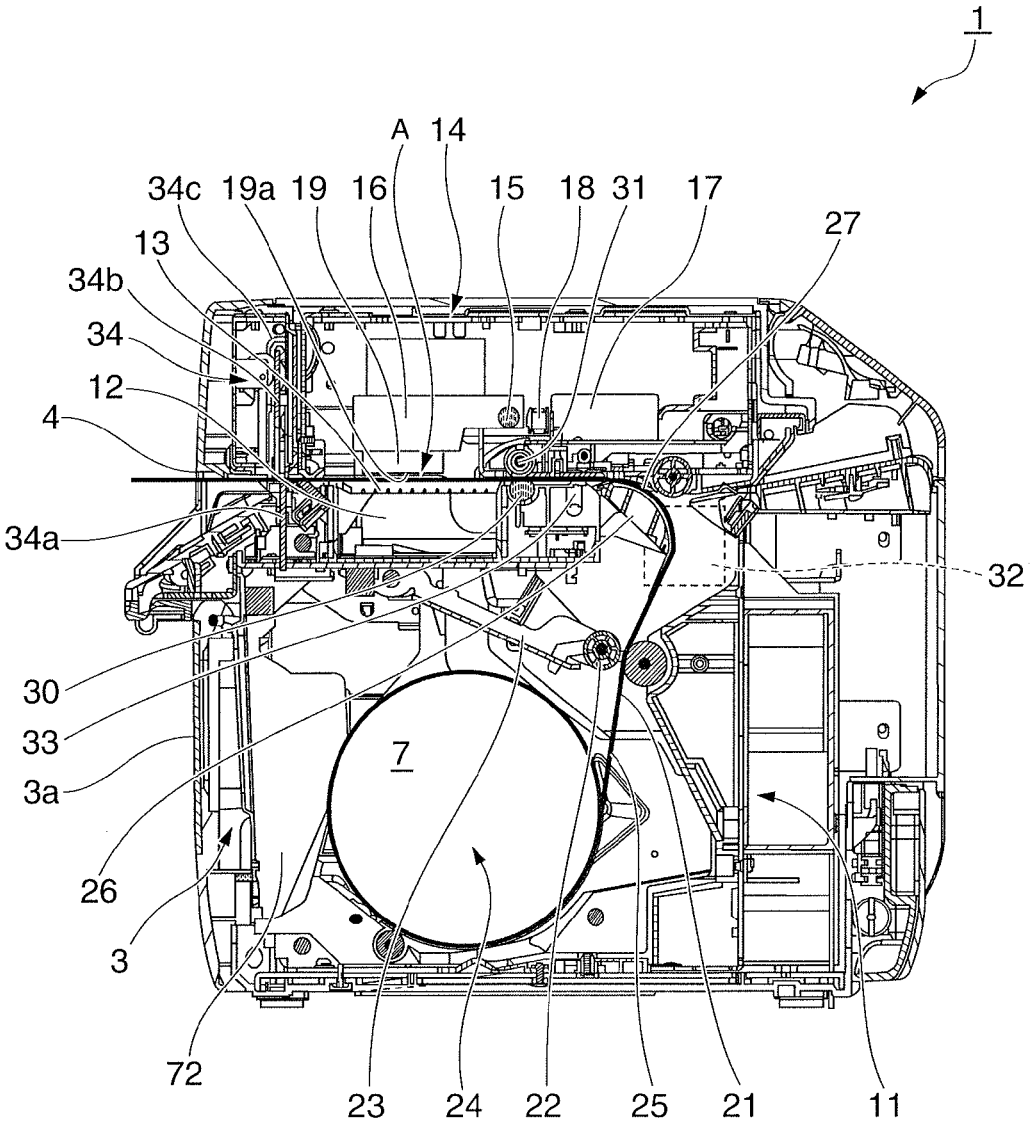
FIG. 3 describes the internal structure of the printer.

FIG. 3 describes the internal structure of the printer housing 2. A main printer frame 11 made of sheet metal is disposed inside the printer housing 2, and the roll paper compartment 7 is formed in the widthwise center of the main printer frame 11. A sheet metal platen frame 12 that extends horizontally widthwise to the printer is disposed above the roll paper compartment 7. A platen 13 that extends horizontally widthwise to the printer is disposed on top of the platen frame 12.

A head unit frame 14 is disposed above the platen 13, and the head unit frame 14 is attached horizontally to the top end of the main printer frame 11. A carriage guide shaft 15 is disposed to the head unit frame 14 widthwise to the printer, and a carriage 16 is supported on the carriage guide shaft 15 so that the carriage 16 can move along the carriage guide shaft 15. The carriage 16 is moved bidirectionally along the carriage guide shaft 15 by a carriage drive mechanism that includes a carriage motor 17 and timing belt 18. An inkjet head 19 (printhead) is mounted on the carriage 16. The nozzle surface 19*a* of the inkjet head 19 opposes the top of the platen 13 with a specific gap therebetween, and the printing position A is defined by the top surface of the platen 13.

The internal structure of the printer along the paper transportation path from the roll paper compartment 7 passed the printing position to the paper exit 4 is described next.

A supply roller 21 that extends horizontally widthwise to the printer is disposed at a position toward the back of the printer inside the roll paper compartment 7, and a pressure roller 22 is pressed against the supply roller 21 from the side to the front of the printer. The pressure roller 22 is attached to the distal end of a pressure lever 23, which is attached to the bottom of the platen frame 12, and the pressure roller 22 is pressed to the supply roller 21 by the pressure lever 23, which is urged downward by a spring force not shown. The supply roller 21 is rotationally driven by a motor not shown mounted on the main printer frame 11. The web of recording paper 25 supplied from the paper roll 24 stored in the roll paper compartment 7 is pulled upward between the supply roller 21 and pressure roller 22 toward the back end of the platen frame 12.

A tension guide 26 is attached to the back end part of the platen frame 12 horizontally widthwise to the printer so that the tension guide 26 can pivot vertically. The tension guide 26 is constantly urged upward by a spring member not shown, and can be elastically displaced downward against the force of the spring. The tension guide 26 has a convex guide surface 27 that projects toward the back of the printer. Recording paper 25 pulled upward between the lower supply roller 21 and pressure roller 22 travels around the guide surface 27 of the tension guide 26, curves from the bottom to the front around the guide surface 27, and is pulled horizontally to the front toward the printing position A.

A paper feed roller 30 extends horizontally widthwise to the printer at a position in front of the tension guide 26 on the platen frame 12. A pressure roller 31 of a specific width is pressed from above with specific pressure to the paper feed roller 30. The paper feed roller 30 is driven by a paper feed motor 32 mounted on the main printer frame 11. The recording paper 25 pulled horizontally to the front passed the tension guide 26 passes between the paper feed roller 30 and pressure roller 31 and is pulled to the front printing position A.

An automatic cutter 34 is disposed to the front end of the platen frame 12. The automatic cutter 34 includes a fixed knife 34*a* that extends widthwise to the printer on the main printer frame 11 side, a movable knife 34*b* that extends widthwise to the printer on the head unit frame 14 side, and a movable knife drive mechanism 34*c* that is also disposed on the head unit frame 14 side. After passing the printing position, the recording paper 25 is discharged to the outside from the paper exit 4 after passing the cutting position of the automatic cutter 34.

When loading a paper roll 24 into the roll paper compartment 7 in this printer 1, the cover unit 3 is opened until it is horizontal. When the cover unit 3 opens, the platen frame 12, tension guide 26, paper feed roller 30, pressure lever 23, and pressure roller 22 move to the front of the printer together with the access cover 3*a*, and the paper transportation path is opened. The paper roll 24 from which a leader of recording paper 25 is pulled off is then dropped into the roll paper compartment 7.

When the access cover 3*a* then closes, the platen frame 12, tension guide 26, paper feed roller 30, pressure lever 23, and pressure roller 22 return to their original positions. As a result, the recording paper 25 is threaded between the supply roller 21 and pressure roller 22, around the guide surface 27 of the tension guide 26, between the paper feed roller 30 and pressure roller 31 passed the printing position A, and out the paper exit 4. When the recording paper 25 is thus loaded, the paper feed roller 30 is driven and the supply roller 21 is driven synchronously to the paper feed roller 30, the recording paper 25 is conveyed toward the printing position A, printed on by the inkjet head 19 at the printing position, and then discharged from the paper exit 4 passed the cutting position of the automatic cutter 34.

When printing on recording paper 25 of a specific width wound into a paper roll 24 in the printer 1 according to this embodiment of the invention, the recording paper 25 is conveyed over the guide surface 27 (first guide surface) of the tension guide 26 as shown in FIG. 3.

However, when printing to a paper roll 24A of recording paper 25A (see FIG. 7) that is used for making wrist bands and is narrower than recording paper 25, the removable guide 40 (see FIG. 4, FIG. 7) or removable guide 80 (see FIG. 8, FIG. 9) described below is installed to the tension guide 26, and the recording paper 25A is conveyed around the removable guide.

To install the removable guide to the tension guide 26, the cover release lever 6 is operated to unlock the cover unit 3, and the discharge guide 5 mounted on the cover unit 3 is pulled forward. As a result, as shown in FIG. 2, the cover unit 3 pivots forward and open on the bottom end thereof to a substantially horizontal position. Because the platen frame 12 moves forward with the cover unit 3, the removable guide can be attached to the tension guide 26 disposed to the back end part of the platen frame 12.

Removable Guide

Figure 4A:
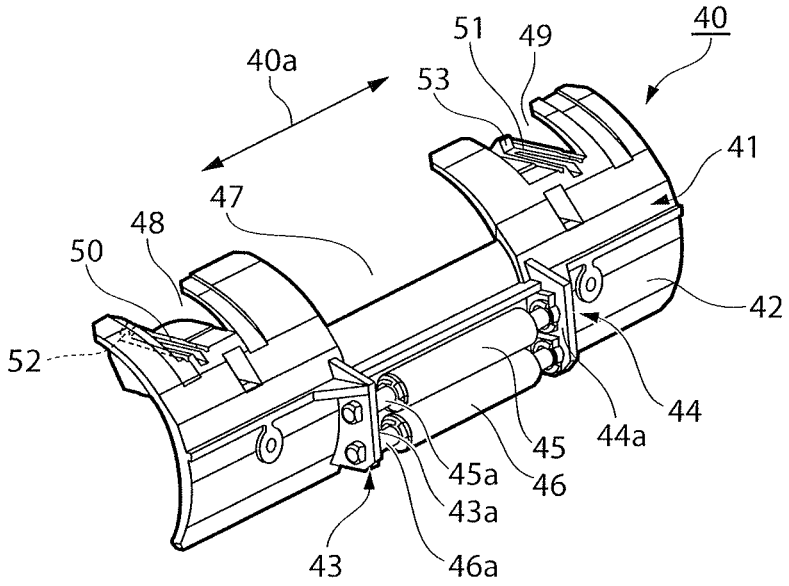
FIG. 4A and FIG. 4B are oblique views of the removable guide from the top and back sides thereof.
Figure 4B:
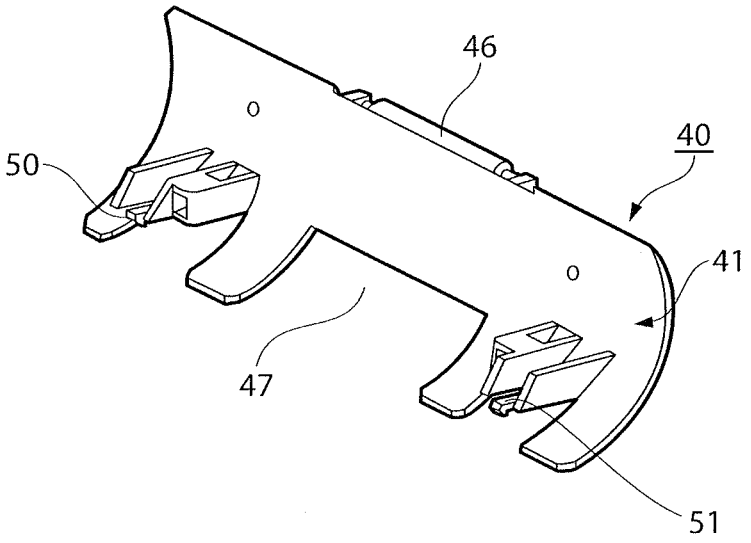

FIG. 4A is an oblique view of the removable guide from the side, and FIG. 4B is an oblique view of the removable guide from the back side. As shown in these figures, the removable guide 40 has a guide panel 41 and a left and right pair of paper width guides 43, 44 disposed to middle of the width 40*a* of the convexly curved outside surface 42 of the guide panel 41. The guide panel 41 is long and narrow, curved when seen in section, and has a substantially constant thickness, and the paper width guides 43, 44 rise perpendicularly to the outside surface 42. The inside surfaces of the paper width guides 43, 44 are paper width guide surfaces 43*a*, 44*a*. Two rollers 45, 46 extending parallel to the width 40*a* are disposed between the paper width guides 43, 44 with the ends of the roller shafts 45*a*, 46*a* freely rotatable. A recording paper guide surface (second guide surface) is rendered by these two rollers 45, 46.

A rectangular notch 47 is formed between the left and right paper width guide surfaces 43*a*, 44*a* at the front end of the guide panel 41. Notches 48, 49 are also formed at the front end of the guide panel 41 on opposite sides of the notch 47, and engagement arms 50, 51 that extend straight diagonally to the back side of the guide panel 41 are formed in these notches 48, 49. Hooks 52, 53 that protrude upward are formed at the distal ends of the engagement arms 50, 51.

Figure 5A:
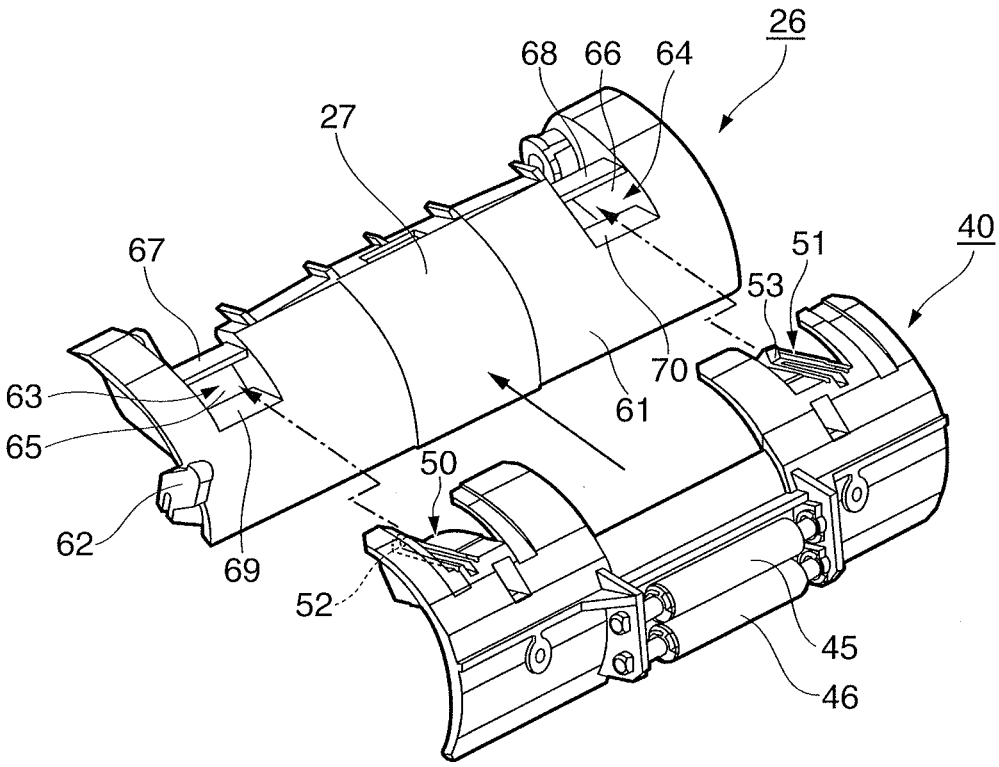
FIG. 5A and FIG. 5B are oblique views of the removable guide before and after installation.
Figure 5B:
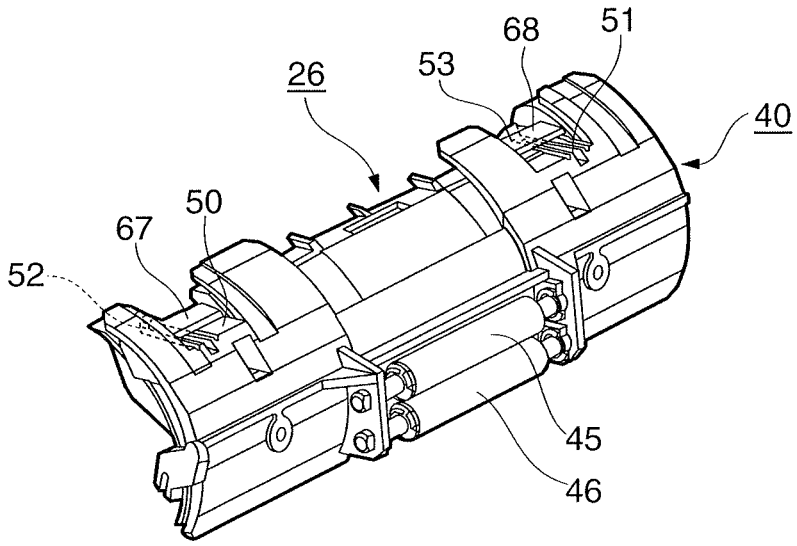

FIG. 5A is an oblique view of the removable guide 40 before it is installed to the tension guide 26, and FIG. 5B is an oblique view of the removable guide 40 when installed to the tension guide 26. As shown in FIG. 5A, the tension guide 26 has a main guide panel 61 and a protrusion 62. The main guide panel 61 has a convex guide surface 27 that curves down toward the back of the printer. The protrusion 62 projects upward diagonally toward the back of the printer from one widthwise side of the main guide panel 61.

Mounting units 63, 64 for removably installing the removable guide 40 are formed on opposite sides of the width of the main guide panel 61. The mounting units 63, 64 respectively have rectangular notches 65, 66; flat upper installation guides 67, 68 that extend widthwise to the printer at the tops of the notches 65, 66; and lower installation guides 69, 70 that extend widthwise to the printer at the bottom ends of the notches 65, 66.

The removable guide 40 is installed to the tension guide 26 by inserting the left and right engagement arms 50, 51 to the left and right mounting units 63, 64 of the tension guide 26. When the removable guide 40 is installed to the tension guide 26, the concave back surface of the guide panel 41 of the removable guide 40 contacts the convex guide surface 27 of the tension guide 26, and the hooks 52, 53 engage the upper installation guides 67, 68.

Operating Effect of the Removable Guide

Figure 6:
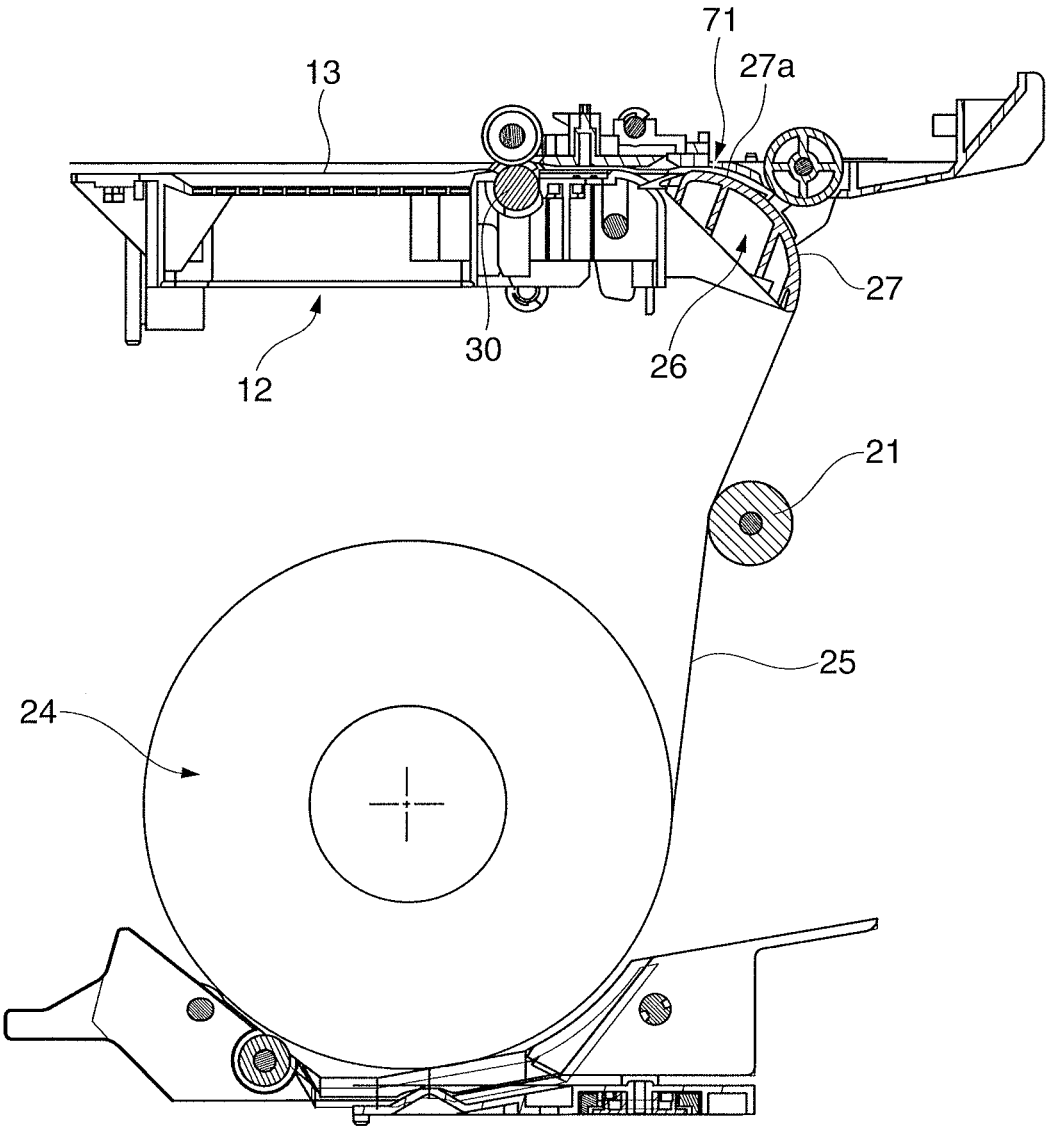
FIG. 6 describes guiding the recording paper by means of the tension guide.
Figure 7:
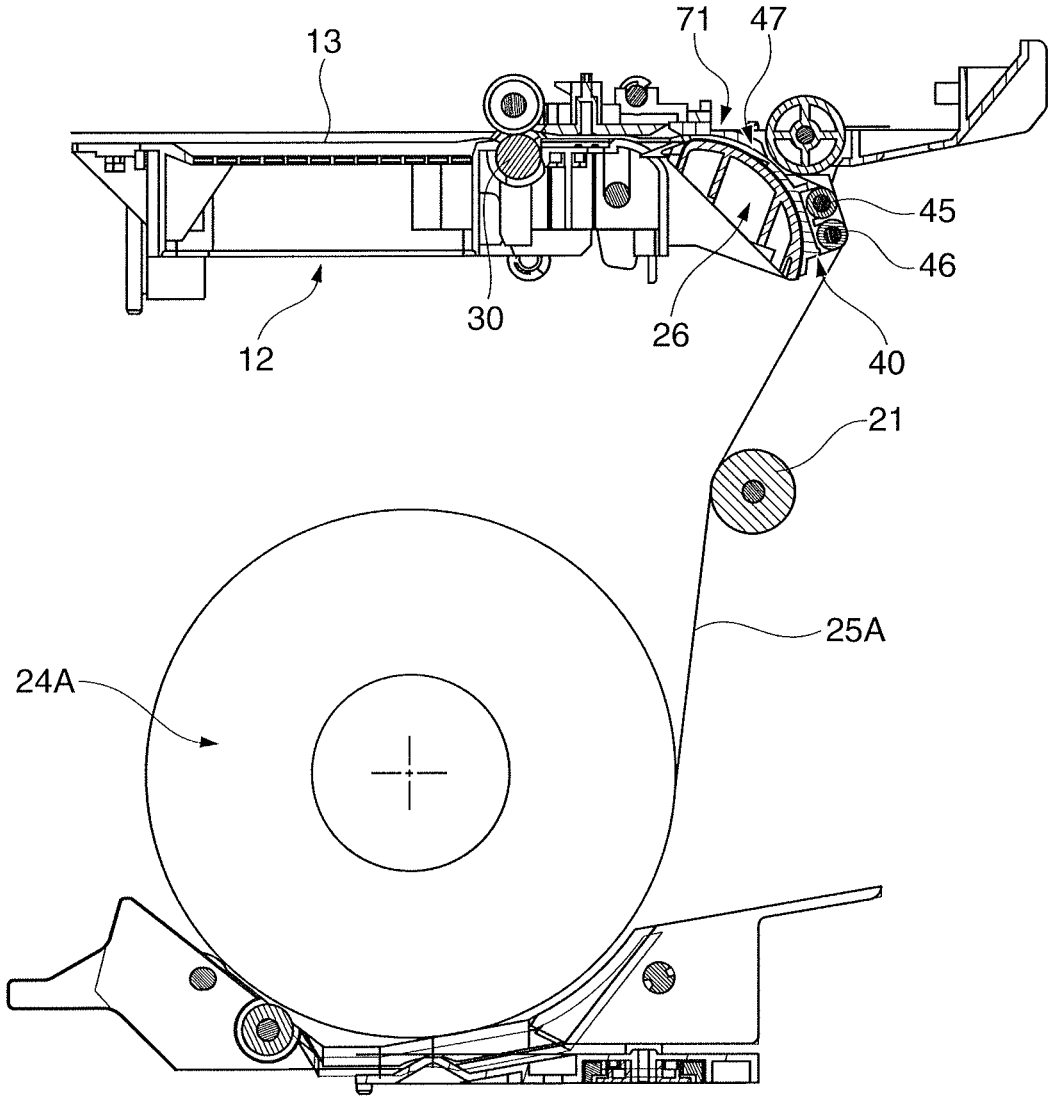
FIG. 7 describes guiding the recording paper by means of the removable guide.

FIG. 6 describes the paper transportation path of the printer 1, and FIG. 7 shows the paper transportation path when the removable guide is installed.

When printing on recording paper 25 delivered from normal paper roll 24, the recording paper 25 is threaded over the guide surface 27 of the tension guide 26. The recording paper 25 is thus urged by the guide surface 27 and held in a specific tensioned state. When the recording paper is conveyed, the recording paper 25 slides over the guide surface 27 and is conveyed by the paper feed roller 30 to the printing position A and printed on. The guide surface 27 is a guide surface with a friction coefficient of approximately 0.35 to 0.4.

In order to print on recording paper 25A supplied from a paper roll 24A of narrow media for making wrist bands, the removable guide 40 is installed to the tension guide 26. When the recording paper 25A is threaded through the paper transportation path with the removable guide 40 installed, the recording paper 25A travels over the two rollers 45, 46 of the removable guide 40 as shown in FIG. 7. In other words, the recording paper 25A is guided by the guide surface (second guide surface) defined by the round outside surfaces of the freely rolling rollers 45, 46.

The back side of the recording paper 25A (the side that contacts the rollers 45, 46) has a higher friction coefficient than normal recording paper 25, and when passed over the guide surface 27 of the tension guide 26, the friction coefficient between the paper and the guide surface may exceed the conveyance force of the paper feed roller 30, possibly resulting in being unable to convey the recording paper. However, because this embodiment of the invention guides the recording paper 25A with a high friction coefficient by means of rolling contact with a pair of rollers 45, 46, the paper feed load between the rollers and the recording paper is extremely low. As a result, installing the removable guide 40 prevents being unable to convey recording paper 25A with a high friction coefficient.

The removable guide 40 is mounted on the elastically displaceable tension guide 26, and is elastically displaceable in unison with the tension guide 26. The removable guide 40 therefore also functions as a tension guide, and can hold the recording paper 25A properly tensioned.

The removable guide 40 also has a pair of paper width guide surfaces 43*a*, 44*a*. The removable guide 40 can therefore also be adjusted to the width of narrow recording paper 25A. The recording paper 25A can therefore be prevented from skewing and meandering, and can be conveyed appropriately.

A large rectangular notch 47 is formed in the middle of the front end of the guide panel 41 of the removable guide 40 in this embodiment of the invention. As will be known from FIG. 6, this disposes the downstream-side guide surface portion 27*a* (the portion on the downstream side in the paper feed direction) at the top end of the convex guide surface 27 of the tension guide 26 with a narrow gap to the upper guide panel 71 disposed thereabove.

Therefore, when this downstream-side guide surface portion 27*a* is covered and hidden by the guide panel 41 of the removable guide 40, enough space to guide the recording paper 25A between the downstream-side guide surface portion 27*a* and the upper guide panel 71 cannot be assured. A notch 47 is therefore formed in this embodiment of the invention at the front end of the guide panel 41 of the removable guide 40 so that the recording paper 25A can pass through. If there is sufficient space between the guide surface 27 of the tension guide 26 and the upper guide panel 71, forming the notch 47 in the removable guide 40 is not necessary.

Variations of the Removable Guide

Figure 8:
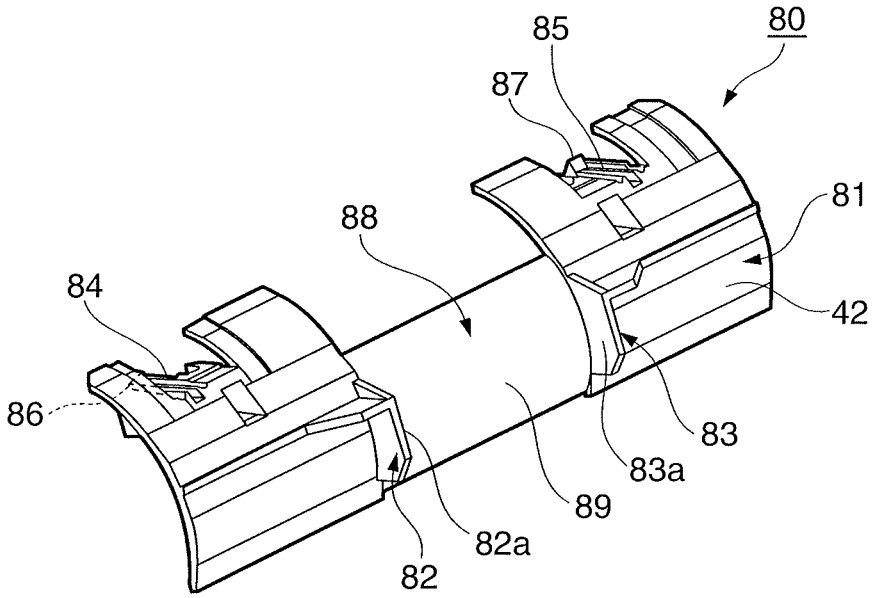
FIG. 8 is an oblique view of a removable guide according to another embodiment of the invention.
Figure 9:
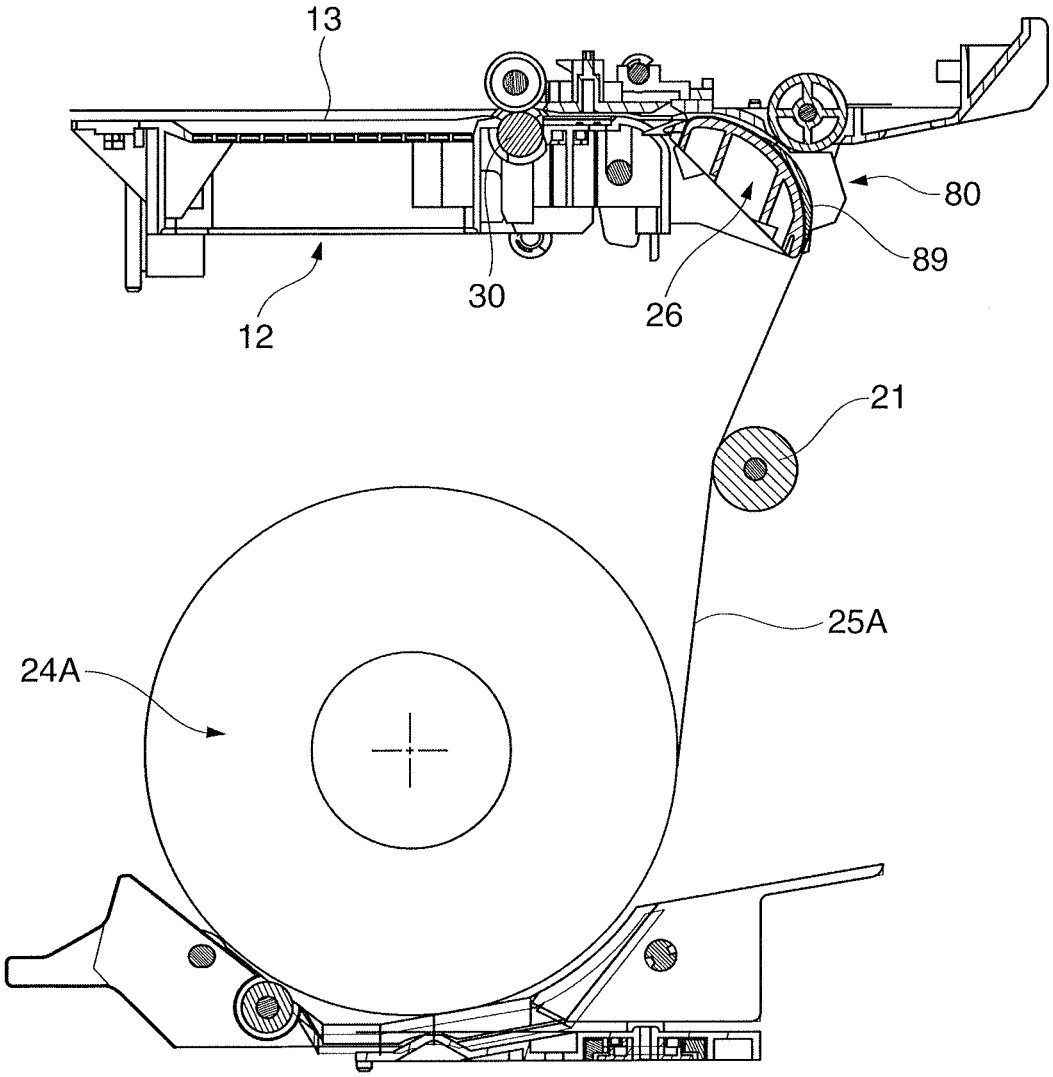
FIG. 9 describes guiding the recording paper by means of the removable guide shown in FIG. 8.

FIG. 8 is an oblique view showing a variation of the removable guide, and FIG. 9 shows this removable guide when installed.

Similarly to the removable guide 40 described above, the removable guide 80 shown in these figures has a guide panel 81 that is long, narrow, and convexly curved when seen in section; a pair of paper width guides 82, 83 disposed to middle of the width of the outside surface of the guide panel 81; and engagement arms 84, 85 formed on opposite sides of the guide panel 81. The inside surfaces of the paper width guides 82, 83 are paper width guide surfaces 82*a*, 83*a*, and hooks 86, 87 are formed at the distal ends of the engagement arms 84, 85.

This removable guide 80 differs from the foregoing removable guide 40 in that a film or sheet 88 made of a material with a low friction coefficient is applied to the outside surface of the guide panel 81 between the paper width guide surfaces 82*a*, 83*a*, and the surface of this sheet 88 renders a guide surface 89 (second guide surface) with a low friction coefficient. The friction coefficient of the guide surface 89 of this sheet 88 is •0.2, and is preferably approximately 0.2 to 0.15. A sheet 88 made of a fluoro plastic such as Nitoflon® (manufactured by Nitto Denko Corp.) can be used as the sheet 88.

This removable guide 80 is used in the same way as the removable guide 40 as shown in FIG. 9. When the removable guide 80 is installed and recording paper 25A is loaded, the recording paper 25A is guided by the guide surface 89 of the sheet 88. Because the friction coefficient of the guide surface 89 is •0.2, the paper feed load caused by sliding resistance with the high friction coefficient recording paper 25A can be kept low. Problems conveying the recording paper 25A as a result of the removable guide 80 being pressed against the recording paper 25A by the force of a spring can therefore be avoided.

This embodiment of the invention forms a guide surface with a low friction coefficient by applying a film or sheet made from a material with a low friction coefficient to the removable guide, but the guide surface could alternatively be created by coating or laminating the surface of the guide panel with a low friction coefficient material to form a surface layer with a low friction coefficient. Further alternatively, the guide surface could be made by affixing a plate made from a low friction coefficient material, such as a molded plastic plate, to the removable guide.

OTHER EMBODIMENTS

An embodiment that prints on recording paper 25A used to make wrist bands is described above, but a removable guide suitable for printing on other types of recording paper can obviously also be made. Further alternatively, a plurality of removable guides each having a guide surface (second guide surface) with a different friction coefficient can be prepared, and the removable guide with a friction coefficient suitable to the recording paper used for printing could be used selectively. In addition, a removable guide with a guide surface having a lower friction coefficient than the tension guide is prepared in the embodiment described above, but a removable guide having a higher friction coefficient than the tension guide is also conceivable.

A roll paper compartment 7 is rendered in the printer 1 in the embodiment described above, but the invention can also be applied to printers that do not have a roll paper compartment. For example, the invention can also be used with printers that print on a recording paper web supplied from an external roll paper holder, or on continuous paper. The printhead is also not limited to an inkjet head, and could be a thermal head, for example.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer, comprising:

a printhead;

a paper feed roller configured to convey a web of recording paper to a printing position of the printhead;

a tension guide that has a first guide surface configured to guide the web of recording paper in a direction of the paper feed roller, the tension guide elastically displaceable to apply specific tension to the web of recording paper; and a removable guide that has a second guide surface with a friction coefficient different from a friction coefficient of the first guide surface, the removable guide removably installable to the tension guide so as to fit the removable guide to the web, wherein when the removable guide is installed to the tension guide, the removable guide is elastically displaceable in unison with the tension guide to guide the web of recording paper by the second guide surface.

2. The printer according to claim 1, wherein the friction coefficient of the second guide surface is lower than the friction coefficient of the first guide surface.

3. The printer according to claim 2, wherein the friction coefficient of the first guide surface is greater than or equal to 0.3; and the friction coefficient of the second guide surface is less than or equal to 0.2.

4. The printer according to claim 1, wherein the removable guide includes a main guide that is removably installable to the tension guide, and at least one roller that is freely rotatably supported by the main guide, and determines the second guide surface.

5. The printer according to claim 2, wherein the removable guide includes a main guide that is removably installable to the tension guide, and the second guide surface is on the main guide.

6. The printer according to claim 1, wherein the removable guide has a pair of paper width guide surfaces formed on opposite sides of the second guide surface.

7. The printer according to claim 1, further comprising:

a plurality of removable guides each having a corresponding second guide surface, wherein friction coefficients of the second guide surfaces of the plurality of removable guides are different from each other, and wherein each of the plurality of removable guides is selectively and removably installable to the tension guide.

8. The printer according to claim 1, further comprising:

a roll paper compartment that stores the web of recording paper wound in a paper roll, wherein the web of recording paper supplied from the paper roll stored in the roll paper compartment is arranged to be guided to the paper feed roller via the tension guide or the removable guide.

9. The printer according to claim 5, wherein the second guide surface is defined by a film, a sheet or a plate with the lower friction coefficient than the first guide surface and applied to a surface of the main guide.

10. The printer according to claim 5, wherein the second guide surface is defined by a surface layer made of a material with the lower friction coefficient than the first guide surface and formed on a surface of the main guide.

* * * * *